US012035809B2

(12) United States Patent
Smith

(10) Patent No.: US 12,035,809 B2
(45) Date of Patent: Jul. 16, 2024

(54) ATTACHABLE CHILD SAFETY SEALABLE BEDDING ENCLOSURE

(71) Applicant: Safe Place Bedding, LLC, Newark, OH (US)

(72) Inventor: Jonathan R. Smith, Newark, OH (US)

( * ) Notice: Subject to any disclaimer, the term of this patent is extended or adjusted under 35 U.S.C. 154(b) by 0 days.

(21) Appl. No.: 17/507,759

(22) Filed: Oct. 21, 2021

(65) Prior Publication Data

US 2022/0117402 A1 Apr. 21, 2022

Related U.S. Application Data

(60) Provisional application No. 63/094,404, filed on Oct. 21, 2020.

(51) Int. Cl.
*A47C 21/02* (2006.01)
*A47D 13/06* (2006.01)
*A47D 15/00* (2006.01)

(52) U.S. Cl.
CPC ..... *A47C 21/024* (2013.01); *A47D 13/063* (2013.01); *A47D 15/008* (2013.01)

(58) Field of Classification Search
CPC .... A47C 21/024; A47D 15/008; A47D 13/06; A47D 13/061; A47D 13/063; A47D 13/065; A47D 13/066; A47D 13/068
See application file for complete search history.

(56) References Cited

U.S. PATENT DOCUMENTS 1,950,603 A * 8/1951 Fischer ..... A47D 13/065 256/25
2,563,915 A * 8/1951 Boisselier ..... A47D 13/063 5/98.3
2,784,420 A * 3/1957 Moltane ..... A47D 13/066 5/98.1
4,073,017 A * 2/1978 Stevens ..... A47D 13/063 5/98.1
4,237,914 A 12/1980 Gantz
4,489,451 A 12/1984 Neely
4,590,956 A 5/1986 Griesenbeck
4,745,643 A 5/1988 Clarke
4,852,194 A 8/1989 Langan
4,852,598 A 8/1989 Griesenbeck
4,945,584 A 8/1990 La Mantia
5,088,139 A * 2/1992 Bloom ..... A47D 13/00 190/1
5,241,718 A * 9/1993 Pope ..... A47D 15/008 5/946
5,303,434 A 4/1994 Arnold
RE34,763 E * 10/1994 Tucker ..... A47D 15/008 2/69.5
5,577,276 A * 11/1996 Nicholson ..... A47D 15/008 5/946
5,768,722 A 6/1998 Olson et al.
6,058,528 A * 5/2000 Yang ..... A47D 13/06 5/99.1

(Continued)

FOREIGN PATENT DOCUMENTS

GB 2337924 A 12/1999

*Primary Examiner* — Justin C Mikowski
*Assistant Examiner* — George Sun
(74) *Attorney, Agent, or Firm* — MIP Legal, Ltd.; Bryce D. Miracle, Esq.

(57) ABSTRACT

A child protective sealable bedding enclosure configured to be attachable to existing bed structures.

12 Claims, 17 Drawing Sheets

(56) References Cited

U.S. PATENT DOCUMENTS 6,067,676 A * 5/2000 Carnahan ..... E04H 15/44 5/98.1
6,178,573 B1 * 1/2001 Wagner ..... A47D 15/008 5/946
6,386,657 B1 5/2002 Frifeldt
6,772,458 B2 8/2004 Ellen et al.
8,635,721 B2 * 1/2014 Zhang ..... A47D 13/063 5/98.1
9,144,325 B1 * 9/2015 Sousa ..... A47D 7/002
9,706,854 B1 * 7/2017 Zhou ..... A47D 13/06
9,763,523 B2 * 9/2017 Thomson ..... A47D 13/066
9,848,714 B2 * 12/2017 Burns ..... A47D 13/06
10,194,755 B1 * 2/2019 Flannery ..... A47D 13/063
10,448,752 B1 * 10/2019 Flannery ..... A47D 13/063
11,266,253 B1 * 3/2022 Flannery ..... A47D 9/00
2003/0029489 A1 2/2003 Zheng
2004/0065361 A1 4/2004 Pratt et al.
2004/0074155 A1 4/2004 Toledo
2005/0034232 A1 * 2/2005 Martin ..... A47D 7/02 5/93.1
2005/0150046 A1 * 7/2005 Gehr ..... A47D 13/063 5/99.1
2007/0062651 A1 * 3/2007 Lippard ..... A01K 1/035 160/135
2007/0214576 A1 * 9/2007 Espenshade ..... A47D 15/003 5/99.1
2009/0007337 A1 * 1/2009 Mese ..... A47D 15/003 5/655
2012/0030879 A1 * 2/2012 Waters ..... A47G 27/0212 5/663
2012/0216346 A1 * 8/2012 Rampton ..... A47D 13/061 256/25
2013/0097784 A1 * 4/2013 Kaplan ..... A47D 15/00 5/663
2014/0208505 A1 * 7/2014 Burkholder ..... A47D 7/002 5/99.1
2014/0246064 A1 * 9/2014 Swanson ..... A47C 29/003 135/121
2015/0021453 A1 * 1/2015 Brassard ..... A45F 5/00 29/401.1
2015/0121618 A1 * 5/2015 Svei ..... A47D 9/00 5/93.1
2017/0367498 A1 * 12/2017 Waters ..... A47D 15/00
2018/0035821 A1 * 2/2018 Bass-Conn ..... A47D 9/00
2018/0214728 A1 * 8/2018 Ben Meir ..... E04H 4/0056
2019/0246806 A1 * 8/2019 Beghtel ..... A47C 31/10
2019/0350378 A1 * 11/2019 Schaffer ..... A47D 13/066
2020/0008585 A1 * 1/2020 Thrift ..... A47D 13/068
2020/0069075 A1 * 3/2020 Gutman ..... G08B 21/0205
2020/0352352 A1 * 11/2020 Fusco ..... A47D 13/061
2021/0137280 A1 * 5/2021 Villano ..... A47D 15/008

* cited by examiner

ATTACHABLE CHILD SAFETY SEALABLE BEDDING ENCLOSURE

RELATED U.S. APPLICATION

This application is based upon and claims the priority filing date of the previously filed, co-pending U.S. provisional patent application entitled "ATTACHABLE CHILD SAFETY BEDDING ENCLOSURE" filed Oct. 21, 2021, having App. No. 63/094,404, the entire disclosure of which is hereby incorporated herein by reference.

FIELD OF THE DISCLOSURE

The invention relates to a child-protective enclosure bed attachable to existing bed structures.

BACKGROUND

It is well known that over 18% of American children under 18 have some type of special needs that require special care. Special Needs Children may be physically, developmentally, behaviorally, and/or sensory impaired. These types of special needs can include Muscular Dystrophy, Multiple Sclerosis, Chronic Asthma, Epilepsy, Down Syndrome, Autism, Dyslexia, Attention Deficit Disorder, Blindness, and/or Deaf.

Children affected with these types of disabilities require a broad range of support and special help that meets their individual needs—each requiring a different amount attention and care. In particular, current special needs bedding can be very expensive, cumbersome, and permanent. Moreover, special needs children who are prone to seizures require special bedding that is safe, soft and configured to prevent injury, requiring a concealed space.

For the foregoing reasons, a bedding space adapted for use by Special Needs Children that is easy to install, semi-permanently attachable to existing bedding structures, and overall safe for children is needed.

SUMMARY

The present disclosure generally provides a child safety bedding enclosure designed to attach to existing bunk beds or similar structures easily.

In certain versions of the application, a sealable bedding enclosure for attaching to an existing bedding structure comprises: a bottom panel having a perimeter; a top panel having a perimeter; a front side panel extending between the bottom panel perimeter and the top panel perimeter; a rear side panel extending between the bottom panel perimeter and the top panel perimeter; and a first and second end panels, each panel extending between the bottom panel perimeter and the top panel perimeter respectively. The bottom panel, top panel, front panel, and opposing side panels collectively form a sealed interior space.

In a version of the application, each vertical corner formed between the respective vertical panels provides a corner attachment flap configured to extend from a first vertical panel, wrap about existing bedding structure, and connect to a second adjacent vertical panel via a plurality of length adjustable straps having respective buckles for connection thereof.

In other versions, the front and rear panels further include a zipper-closable flap made of breathable mesh netting. A zipper is located at the perimeter and configured to open and close to provide ingress and egress to the interior space.

In yet other versions of the application, the first and second side panels further include a first and second side windows that are manufactured of breathable mesh netting.

In a version, the sealable bedding enclosure may include a mattress having a front perimeter, a rear perimeter, and opposing end perimeters forming collectively a rectangular footprint positioned above the bottom panel and interior of the sealable bedding enclosure.

In yet other versions of the application, the sealable bedding enclosure for attachment to an existing bedding structure may include a first front vertical corner; a second front vertical corner; a first rear vertical corner; and a second rear vertical corner. Each of the first front, second front, first rear, and second rear vertical corners formed between the respective vertical panels further includes a primary corner attachment flap.

In a version, the primary corner attachment flap may include a fixed perimeter; a movable perimeter; and an interior surface positioned between the fixed perimeter and the movable perimeter supporting hook and loop material. Further, a secondary corner attachment flap is provided, which is attached to an adjacent second panel and may include a fixed perimeter, a movable perimeter; and an exterior surface positioned between the fixed perimeter and the movable perimeter supporting reciprocal hook and loop material.

In other versions, the primary corner attachment flap may further include a first length adjustable strap and buckle for securing the primary corner attachment flap to the second panel; and a second length adjustable strap and buckle for securing the primary corner attachment flap to the second panel. Wherein, each of the corner attachment flaps is configured to extend laterally from the first panel about a respective bedding structure column and connect to the second panel by connecting the hook and loop material supported by the interior surface of the primary corner attachment flap and the reciprocal hook and loop material supported by the exterior surface of secondary corner attachment flap.

In some versions of the application, the sealable bedding enclosure may further include a plurality of top attachment flaps aligned along the top panel perimeter, each top attachment flap having a fixed perimeter and a movable perimeter, and a plurality of length adjustable straps and buckles that connect the movable perimeters of the plurality of the top attachment flaps over existing bedding structure to the top panel exterior surface.

In a version, the sealable bedding enclosure includes a mattress with a front perimeter, a rear perimeter, and opposing end perimeters forming collectively a rectangular footprint positioned below the bottom panel of the sealable bedding enclosure.

In certain versions of the application, the sealable bedding enclosure may further have a plurality of bottom attachment flaps aligned along the bottom panel perimeter, each having a fixed perimeter and a movable perimeter, and a plurality of length adjustable straps and buckles that connect the movable perimeters of the plurality of the bottom attachment flaps to existing bedding structure, wherein the plurality of bottom attachment flaps are positioned to conceal the mattress front, rear, and opposing end perimeters.

These and other features of the present invention will become readily apparent upon further review of the following specification and drawings.

BRIEF DESCRIPTION OF THE DRAWINGS

For a more complete understanding of this disclosure, reference is now made to the following description, taken in conjunction with the accompanying drawings, in which.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Unless otherwise stated, any reference to "or" herein is intended to encompass "and/or".

Figure 17:
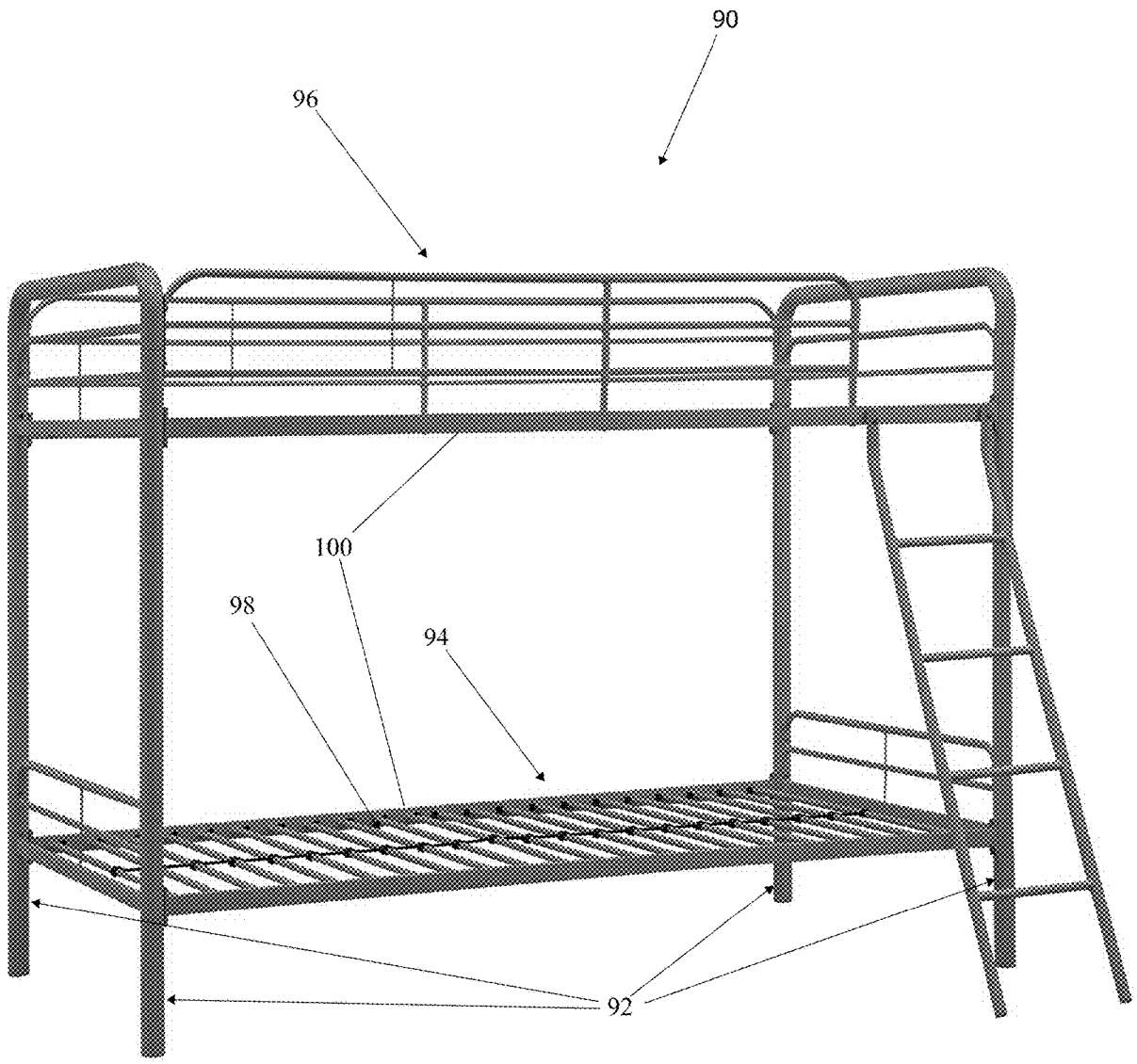
FIG. 17 PRIOR ART
FIG. 17 is an example of prior art existing bunk bed bedding structure.

Embodiments of the present disclosure may provide a sealable bedding enclosure that is attachable to existing bedding structures such as a bunk bed. With reference to FIG. 17, existing bedding structures, such as a bunk bed 90 frame comprise support for two or more mattresses (not shown) in a stacked configuration. Typically, the structure of a bunk bed 90 comprises four columns 92 that provide support for a lower bunk platform 94 and a top bunk platform 96 in a rectangular configuration—each platform 94, 96 having a perimeter 100 and a plurality of lateral slats 98 extending therein which are designed to support a mattress thereon.

Figure 1:
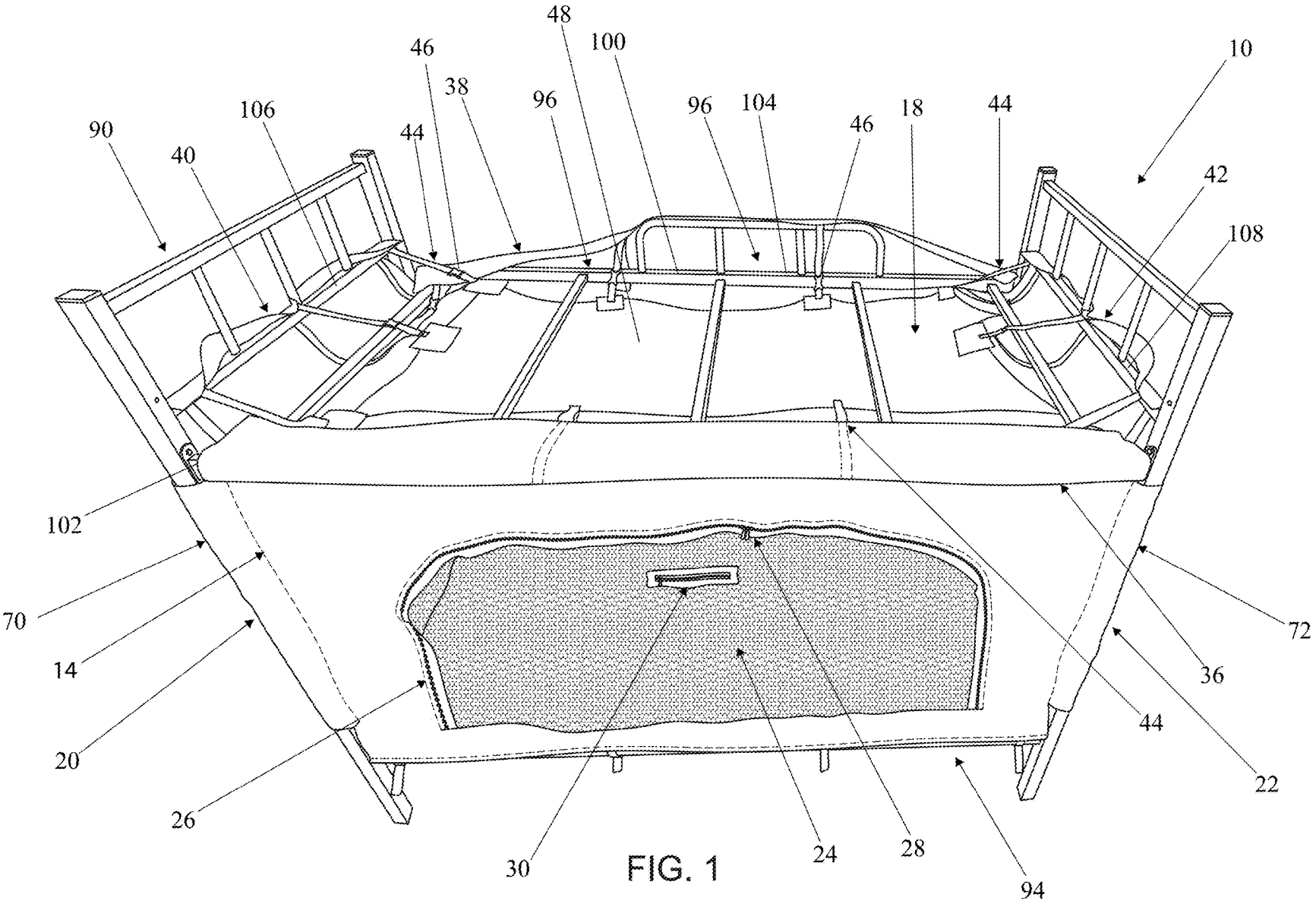
FIG. 1 is a front perspective view of an attachable child safety sealable bedding enclosure.

FIG. 1 is an illustration of a version of the sealable bedding enclosure 10 that is designed to enclose the space between the lower bunk platform 94 and the top bunk platform 96. The sealable bedding enclosure 10 is designed to provide a sealed sleeping space adapted to enclose special needs children therein. The sealable bedding enclosure 10 provides a safe, soft and comfortable place for special needs children to be safely secured for bedtime purposes and other activities. Essentially, the sealable bedding enclosure 10 provides a protective barrier between the child and the outside environment, most relevant in cases of children suffering from seizures or forms of uncontrollable outbursts. Further, the sealable bedding enclosure 10 is lightweight, foldable, compact and easily transported.

As best shown in FIG. 1-FIG. 7, a version of the sealable bedding enclosure 10 generally comprises a mattress 12 enclosed within a bottom panel 11, front panel 14, rear panel 16, top panel 18, first side panel 20, and a second side panel 22, collectively forming the sealed interior space 24. Preferably, the panels are primarily made of a flexible, soft resilient material such as nylon.

Figure 2:
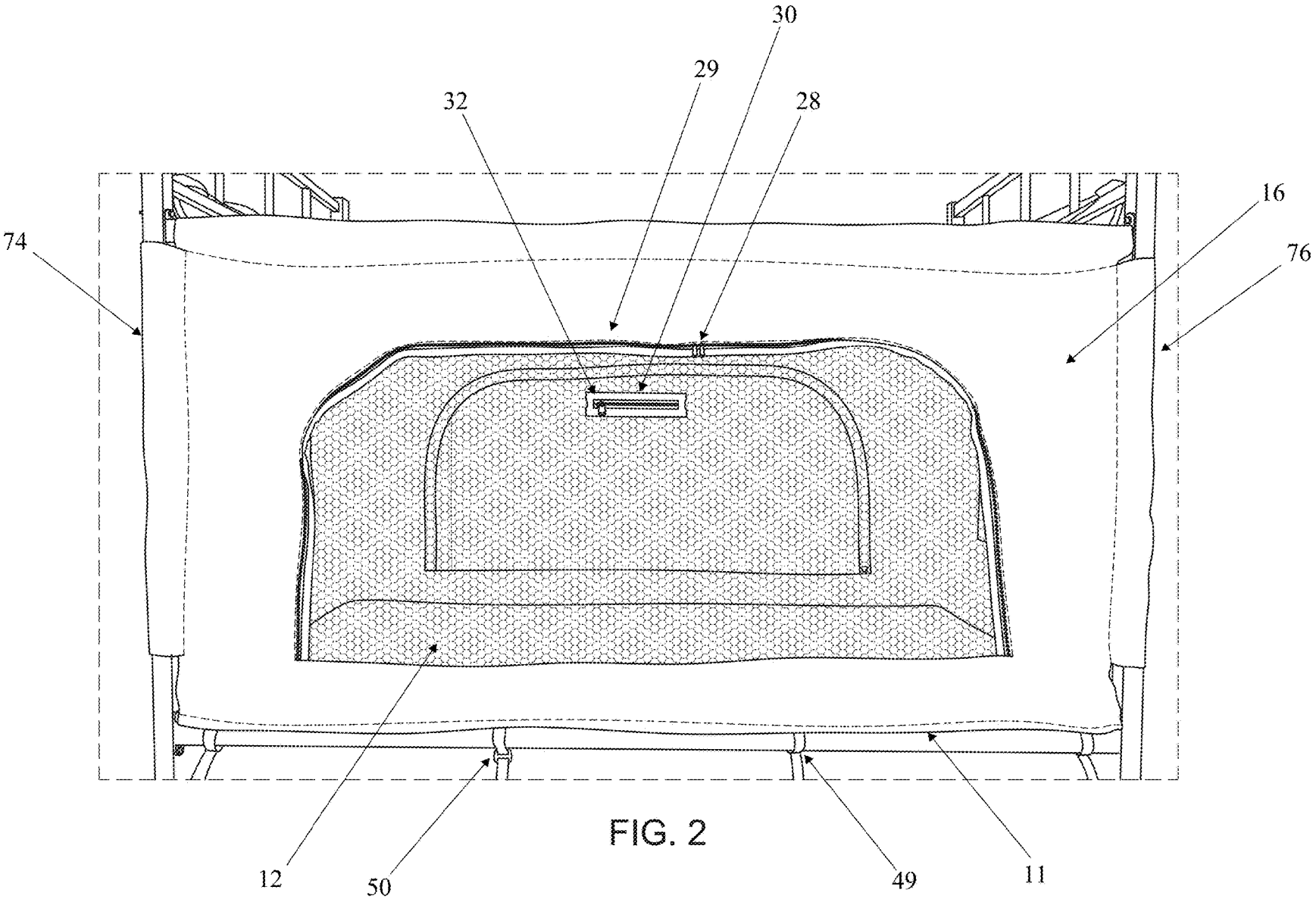
FIG. 2 is a front elevation view of the version of the sealable bedding enclosure shown in FIG. 1.

As best shown in FIG. 1 and FIG. 2, the front panel 14 includes a front flap 26 that provides ingress and egress to the interior space 24. The front flap 26 is opened and closed by way of a zipper 28 positioned at the perimeter thereof. Preferably the front flap 26 is made of a breathable mesh netting allowing fresh air therethrough and into the interior space 24. The front flap 26 or rear flap 29 may further provide a short horizontal divide 30 in order to allow medical equipment or tubing into the interior space 24 or to pass objects to the child without opening the front flap 26 or rear flap 29. The divide may be sealed by a second zipper 32.

The rear panel 16 is essentially the reciprocal of the front panel 14 as shown in FIG. 1. It comprises a rear flap 29 secured and openable via a zipper 28 located at the perimeter of the rear flap 29.

Figure 4:
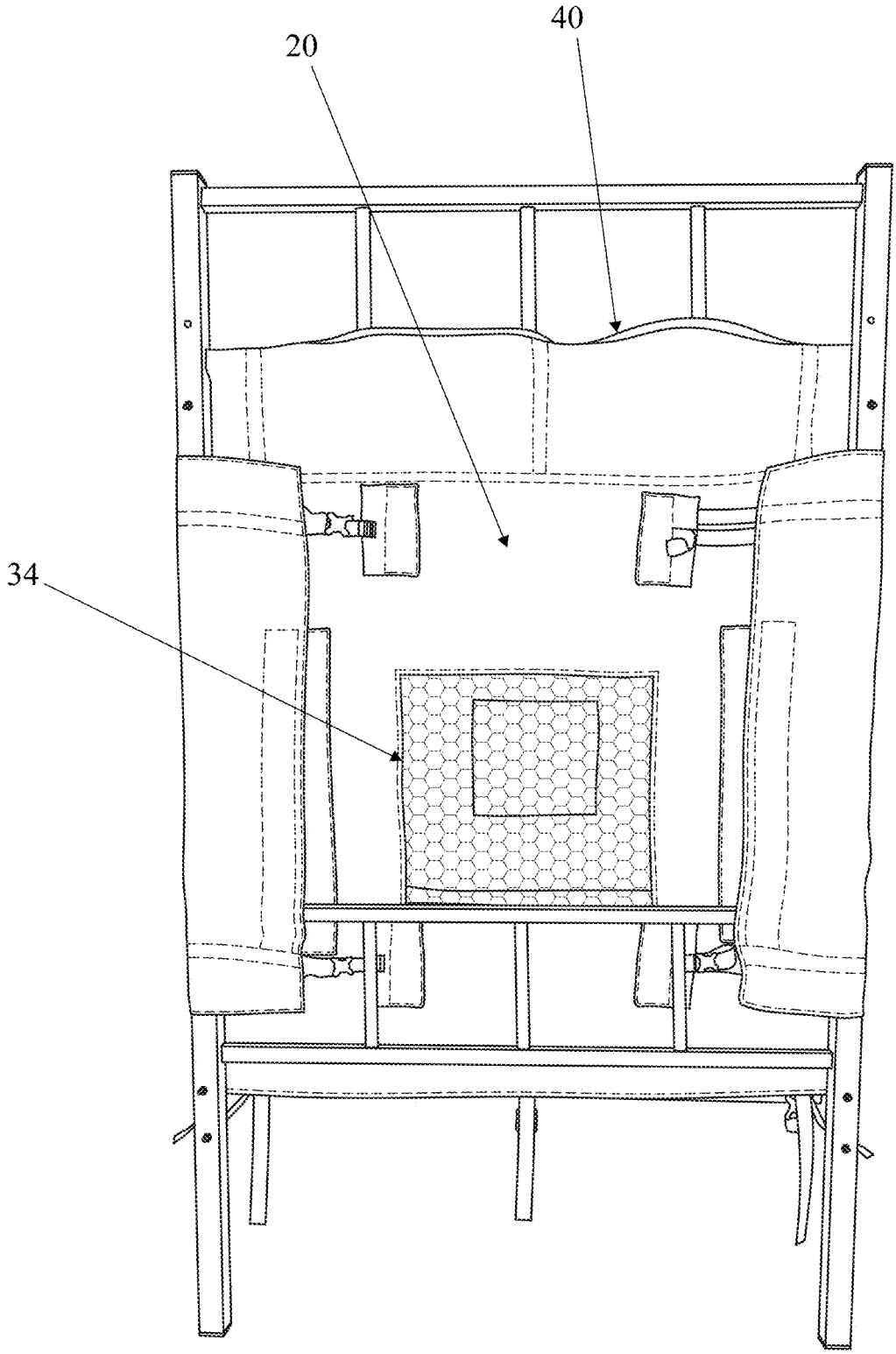
FIG. 4 is a side elevation view of the version of the sealable bedding enclosure shown in FIG. 1.
Figure 5:
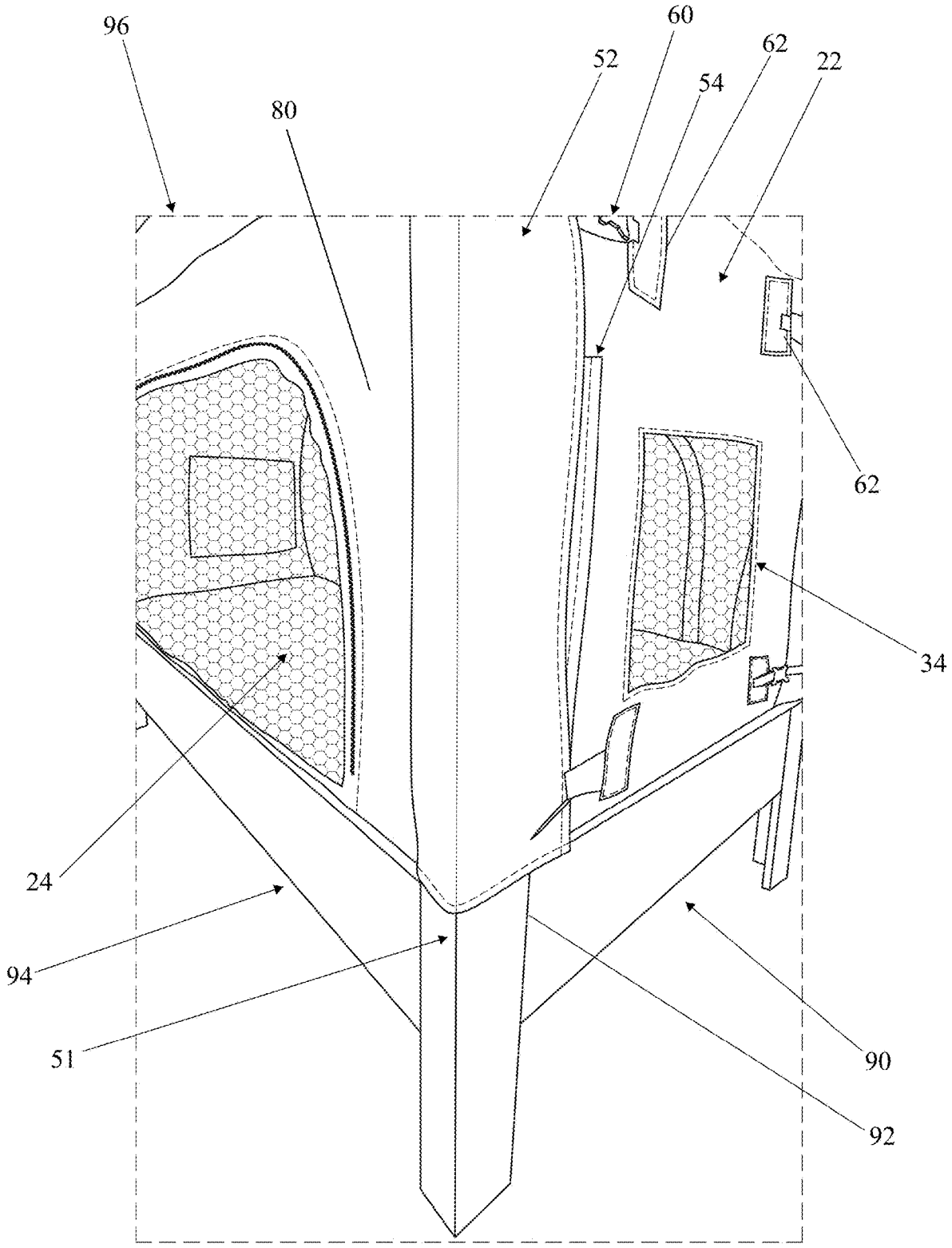
FIG. 5 is a corner view of the version of the sealable bedding enclosure shown in FIG. 1.

As best shown in FIG. 4 and FIG. 5, the first and second end panels 20, 22 enclose the sides of the sealable bedding enclosure 10. Generally, the first and second end panels 20, 22 are reciprocal. The first and second end panels 20, 22 generally comprise a window 34 made of a breathable mesh netting which allows fresh air through and into the sealed interior space 24.

Figure 12:
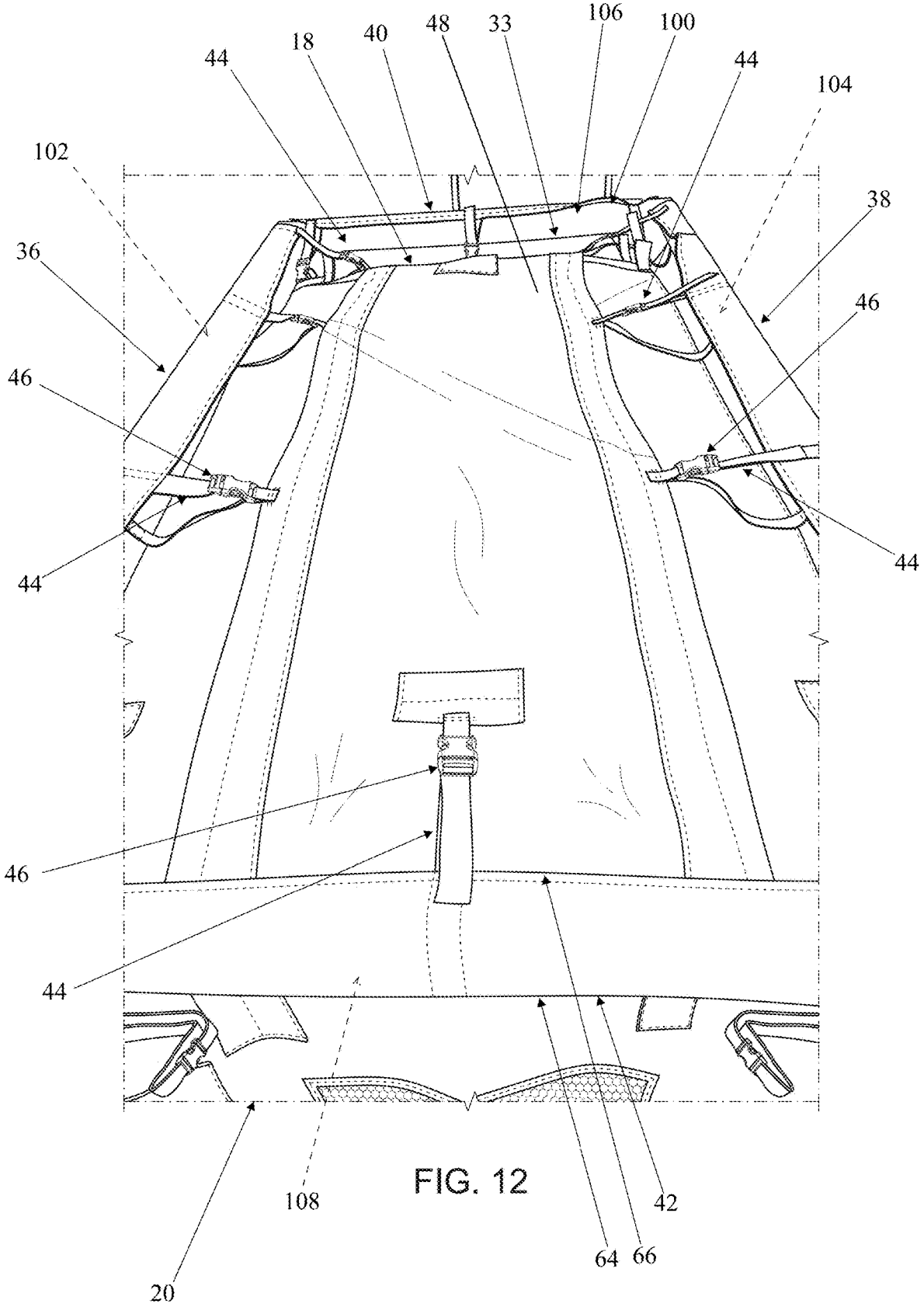
FIG. 12 is a top perspective view of a version of the application.

The top panel 18, as shown in FIG. 1 and FIG. 12 generally comprises a continuous sheet of material enclosing the top of the sealable bedding enclosure 10 forming a rectangular footprint or a box configuration in conjunction with the front panel 14, rear panel 16, and the first and second end panels 20, 22.

Figure 6:
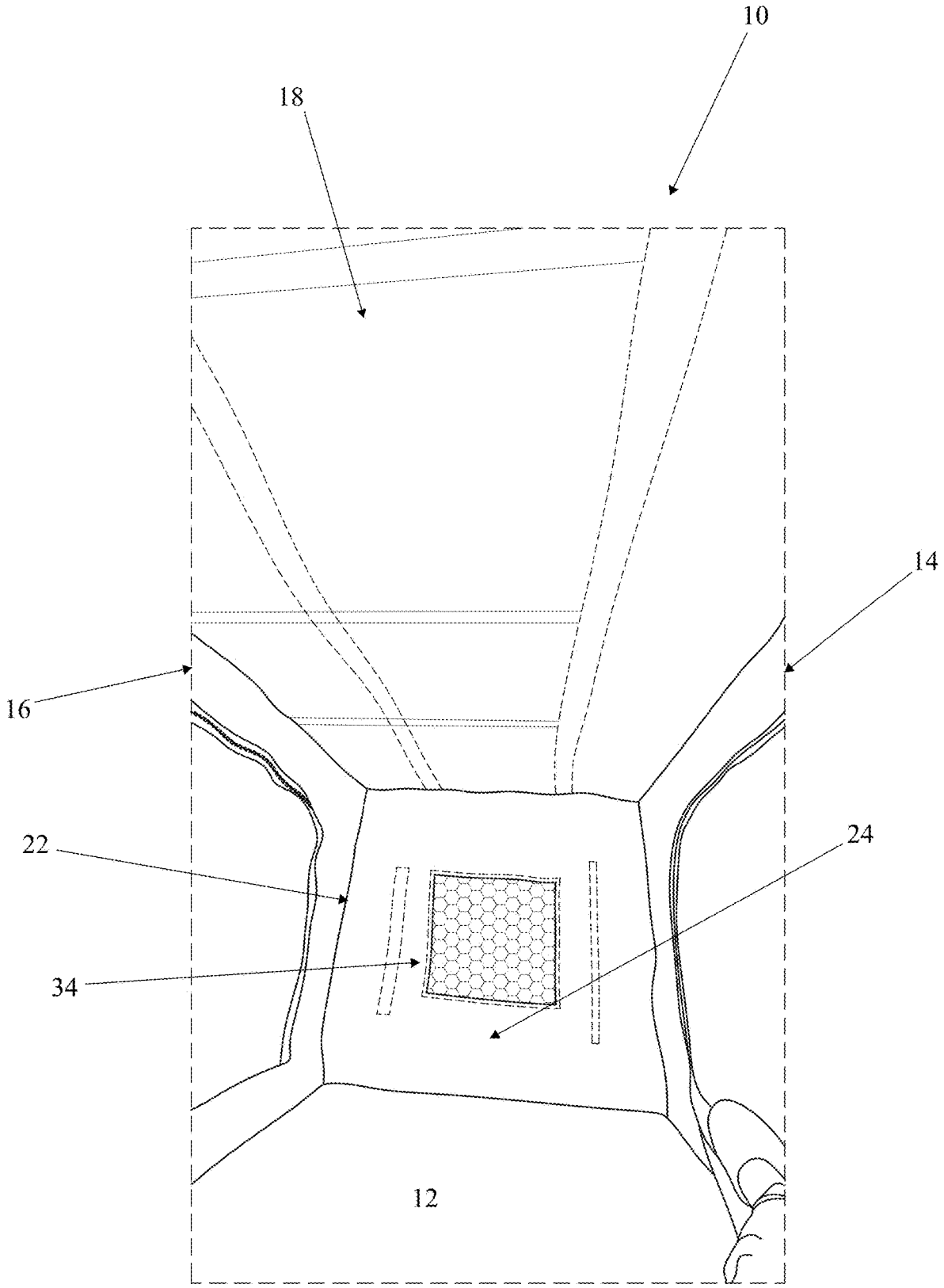
FIG. 6 is an interior view of the version of the sealable bedding enclosure shown in FIG. 1.

FIG. 6 shows an interior view of the sealable bedding enclosure 10 showing the mattress 12 which forms the bottom surface of the interior space 24. Preferably, the mattress 12 provides a depth of cushion having a rectangular footprint such as standard foam, memory foam, or a pillow-top mattress, as is known in the art. The mattress may comprise a front perimeter, a rear perimeter, and opposing end perimeters forming collectively the rectangular footprint.

The sealable bedding enclosure 10 is operably attached to the bedding structure 90 by way of a plurality of strategically positioned fasteners including side release buckles and hook and loop attachment means. With reference to FIG. 1, the top panel 18 of the sealable bedding enclosure 10 further provides a plurality of top attachment flaps made of a flexible material. The top attachment flaps are generally aligned along the perimeter 33 of the top panel 18. In the version, each of the top attachment flaps has a fixed perimeter 64 and a movable perimeter 66. Each of the top attachment flaps fixed perimeter 64 is attached along the respective side top panel 18 perimeter 33.

Figure 13:
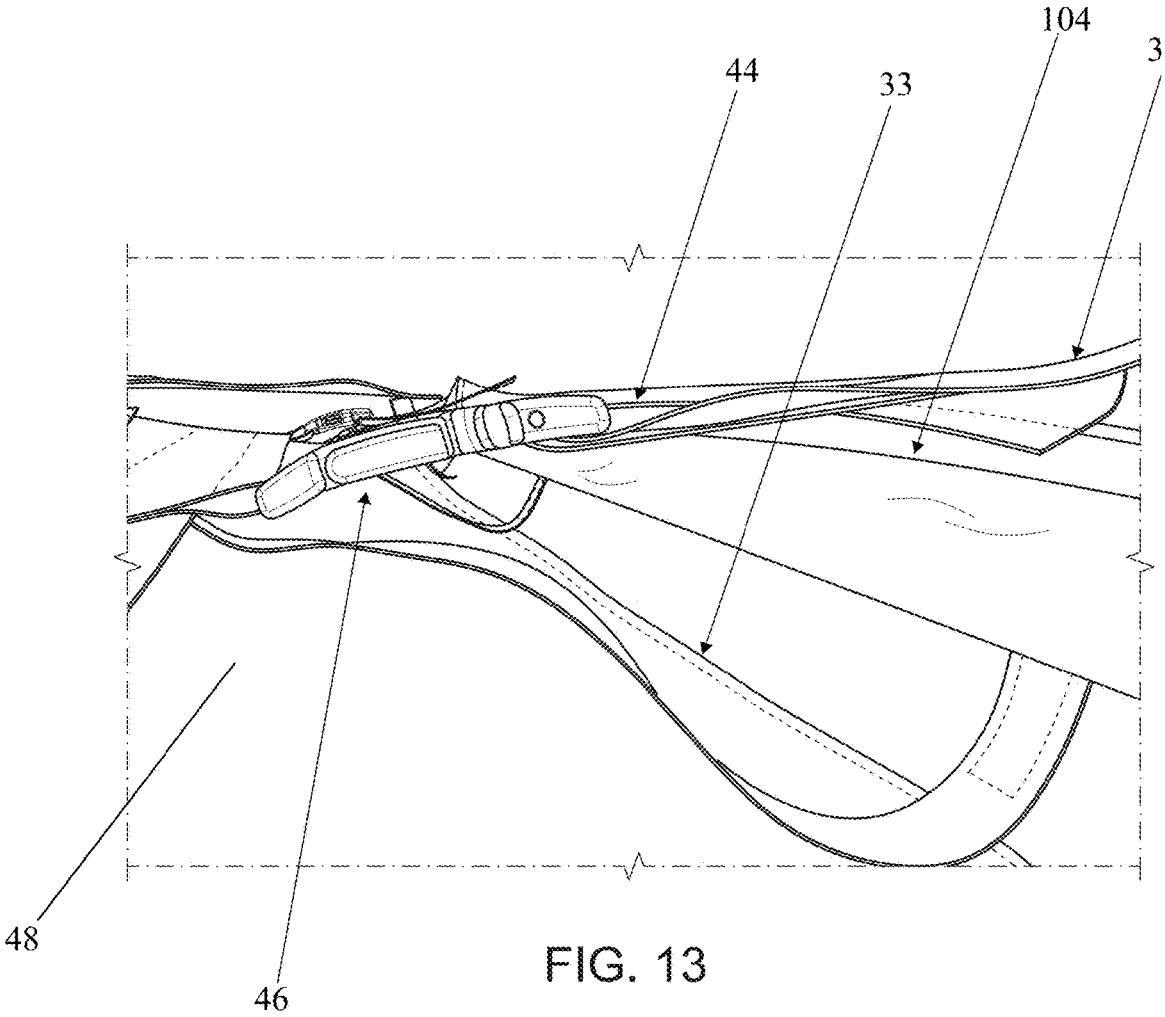
FIG. 13 is an up-close perspective view of the top attachment flap, length adjustable strap, and side release buckle of the version shown in FIG. 12.
Figure 14:
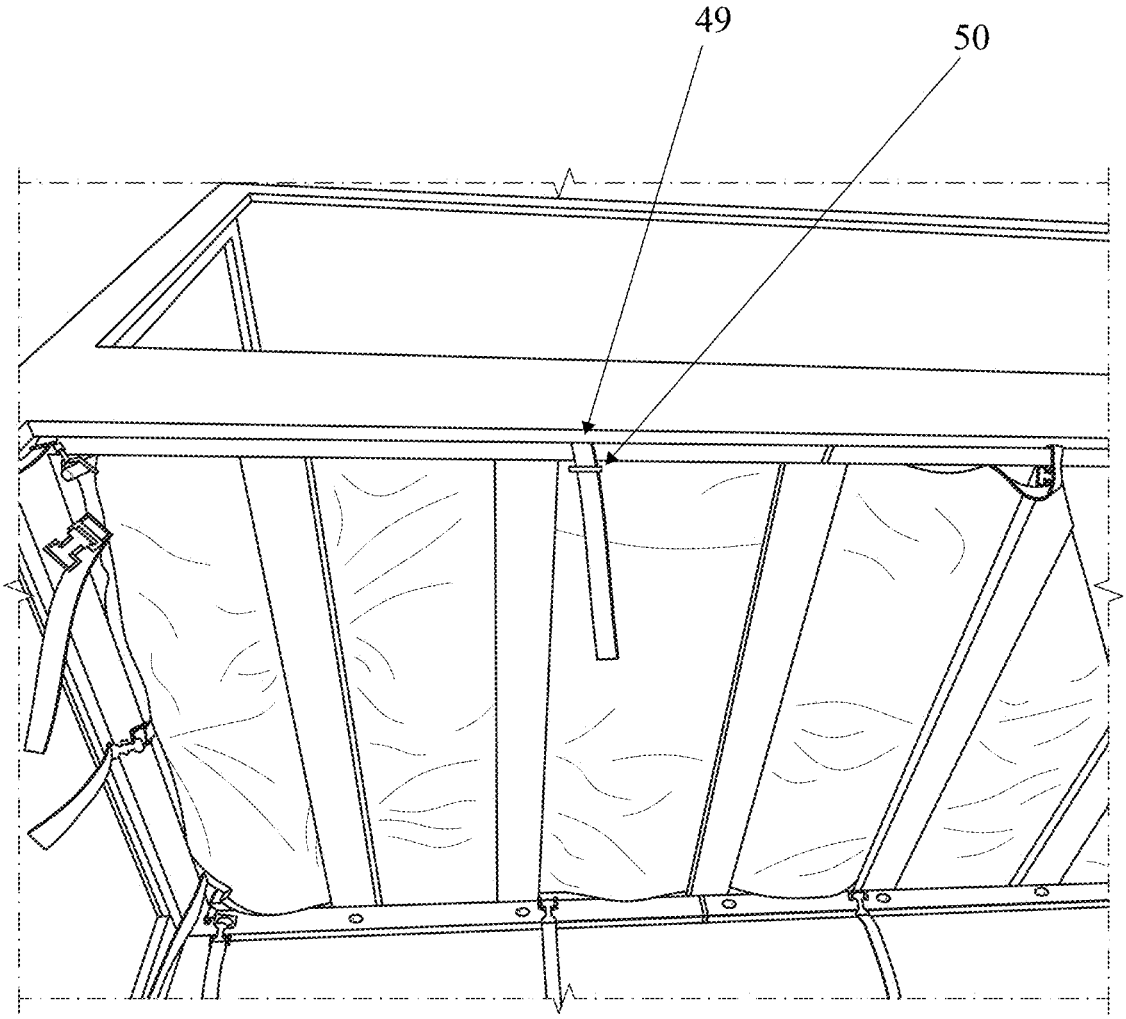
FIG. 14 is a bottom perspective view of a version of the application.

In the version as best shown in FIG. 12 and FIG. 13, the top attachment flaps include a front top attachment flap 36, a rear top attachment flap 38, and opposing first and second end top attachment flaps 40, 42 which are positioned along the perimeter 33 of the top panel 18 and operably extend over the adjacent top bunk platform 96 perimeter structure 100 including a front and rear spars 102, 104 and lateral end structures 106, 108. The top attachment flaps are secured over the adjacent top bunk structure by a plurality of length adjustable straps 44 having side release buckles 46. Thus, as illustrated in FIG. 1, the top of the sealable bedding enclosure 10 is attached to the top bunk platform 96 by folding over the top bunk structure and attaching the respective movable perimeter 66 to the top panel 18 exterior surface 48 of the top panel 18 via a plurality of length adjustable straps 44 having side release buckles 46. Thus, the length of the length adjustable straps 44 can be adjusted in order to accommodate various sized and shaped existing bedding structures 90.

Figure 7:
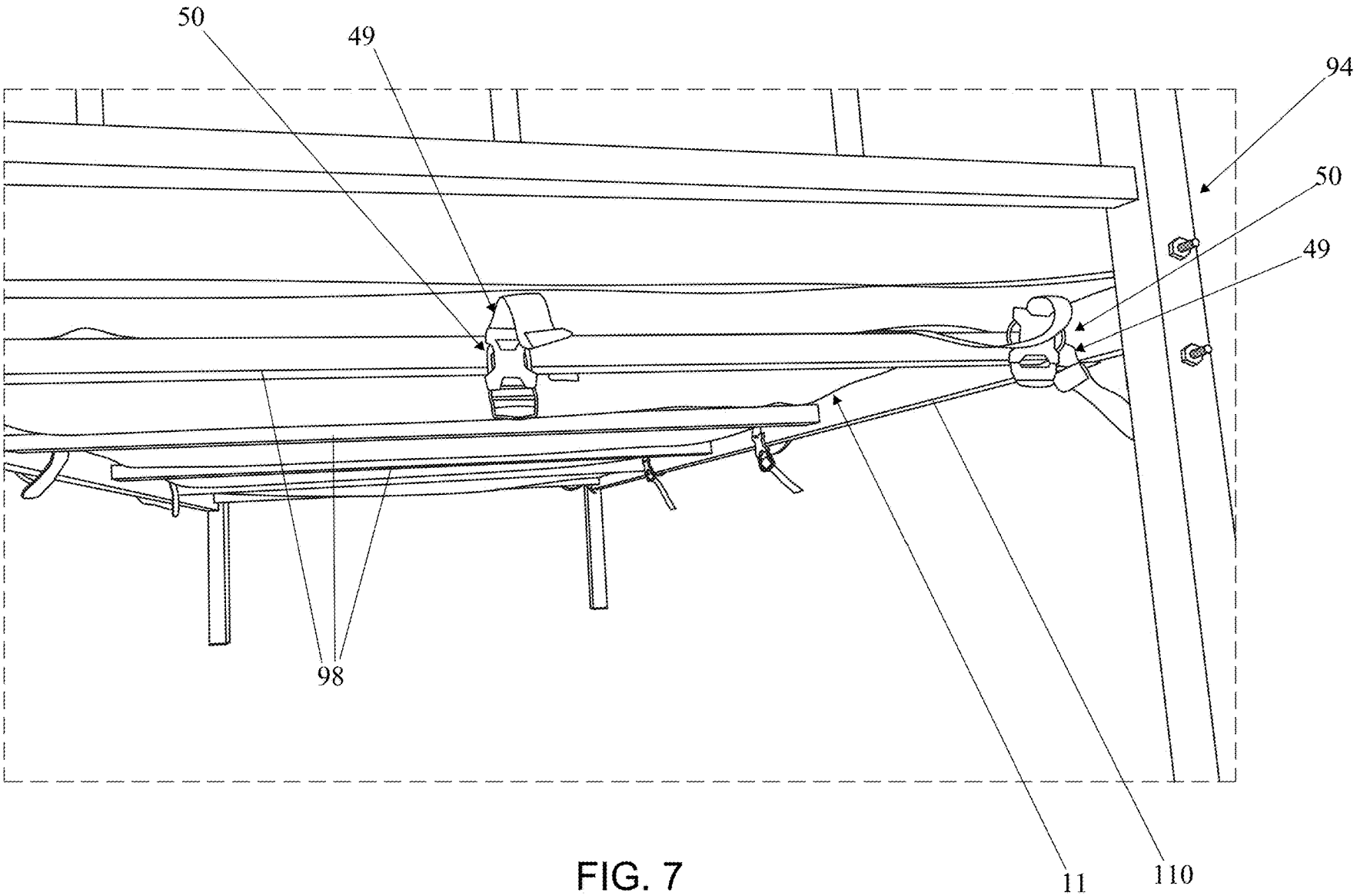
FIG. 7 is a bottom perspective view of the version of the sealable bedding enclosure shown in FIG. 1.

With reference to FIG. 2 and FIG. 7, the bottom panel 11 can be attachable to the lower bunk platform 94 perimeter structure 110 and lateral slats 98 by way of a plurality of straps 49 having side release buckles 50. In the version, the bottom panel 11 generally is in the shape of a rectangle having a perimeter 68 shaped to receive a mattress 12 thereon or thereunder.

As best shown in FIG. 1 and FIG. 2, the sealable bedding enclosure 10 includes a plurality of vertical corners formed between adjacent vertical panels. Specifically, the front panel 14 and the first end panel 20 form a first front side vertical corner 70, the front panel 14 and the second end panel 22 form a second front side vertical corner 72, the rear panel 16 and the first end panel 20 form a first rear side vertical corner 74, and the rear side panel 16 and the second end panel 22 form a second rear side vertical corner 76.

As best shown in FIG. 8-FIG. 11, each of the vertical corners 51 may further include a plurality of respective corner attachment flaps. In the version, the attachment flaps for each respective vertical corner include a primary corner attachment flap 52 and a secondary corner attachment flap 54. In the version, the primary corner attachment flap 52 has a fixed perimeter 78, a movable perimeter 80, and an interior surface 56. The secondary attachment flap 54 has a fixed perimeter 82, a movable perimeter 84 and an exterior surface 58. Generally, the primary corner attachment flap 52 is configured to extend from a first vertical panel, wrap about existing bedding structure or column, and connect to the secondary corner attachment flap 54, thereby securing the respective vertical corner to the bedding structure.

Figure 3:
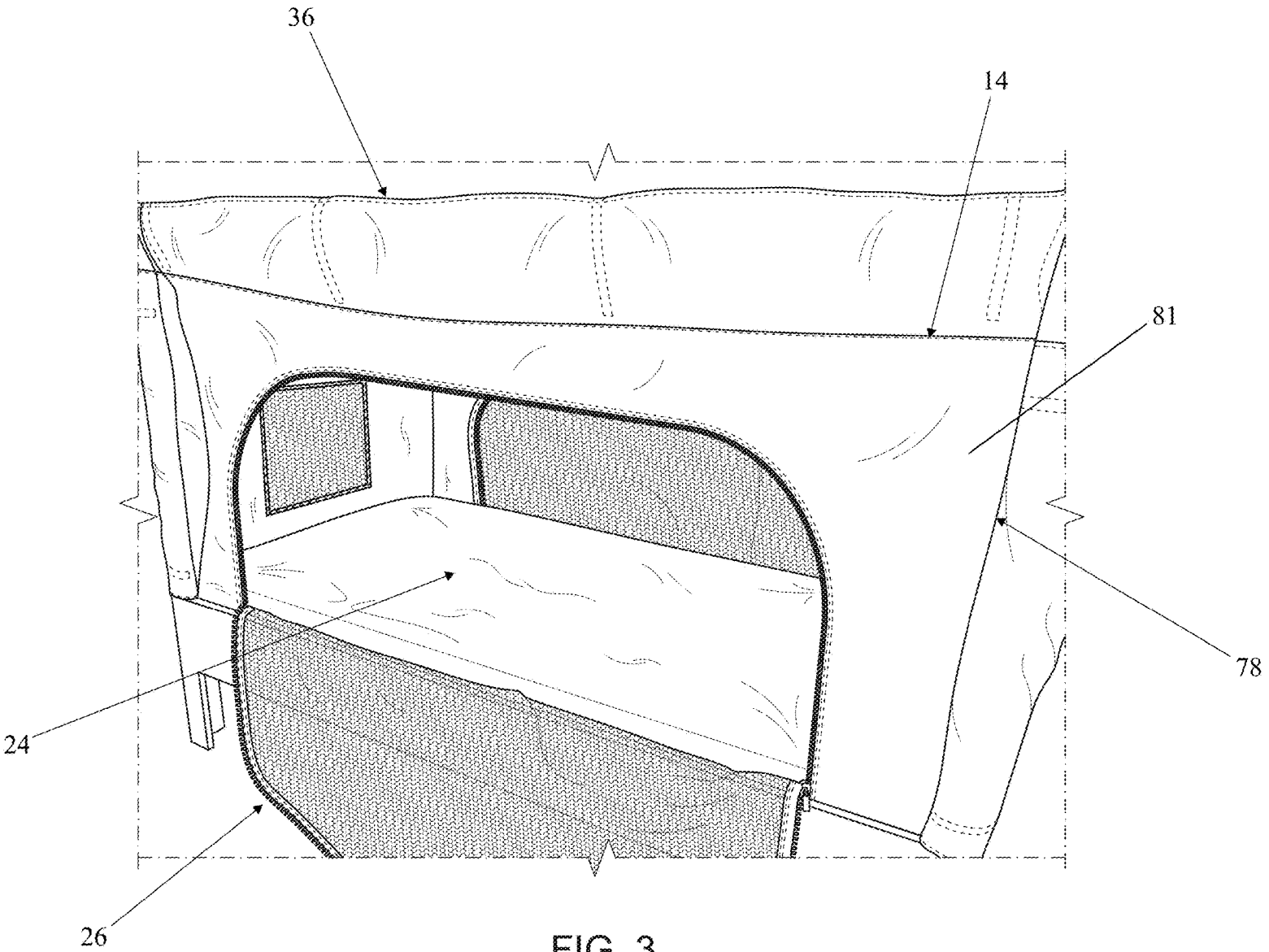
FIG. 3 is a front perspective view of a version of the sealable bedding enclosure.

As illustrated, the primary attachment flap 52 is anchored along a fixed vertical perimeter 78 attached to the exterior surface 81 of a first panel, for example, the front panel 14 (See FIG. 3). The secondary attachment flap 54 is anchored along a fixed vertical perimeter 82 attached to the exterior surface 83 of an adjacent vertical panel, for example, the first end panel 20 (See FIG. 8). The primary corner attachment flaps 52 are configured to wrap around each of the respective bunk bed 90 columns 92 extending between the top bunk platform 96 and the lower bunk platform 94. Each of the primary corner attachment flaps 52 is configured to attach to a respective secondary corner flap 54, which is anchored on the adjacent panel exterior surface.

Figure 8:
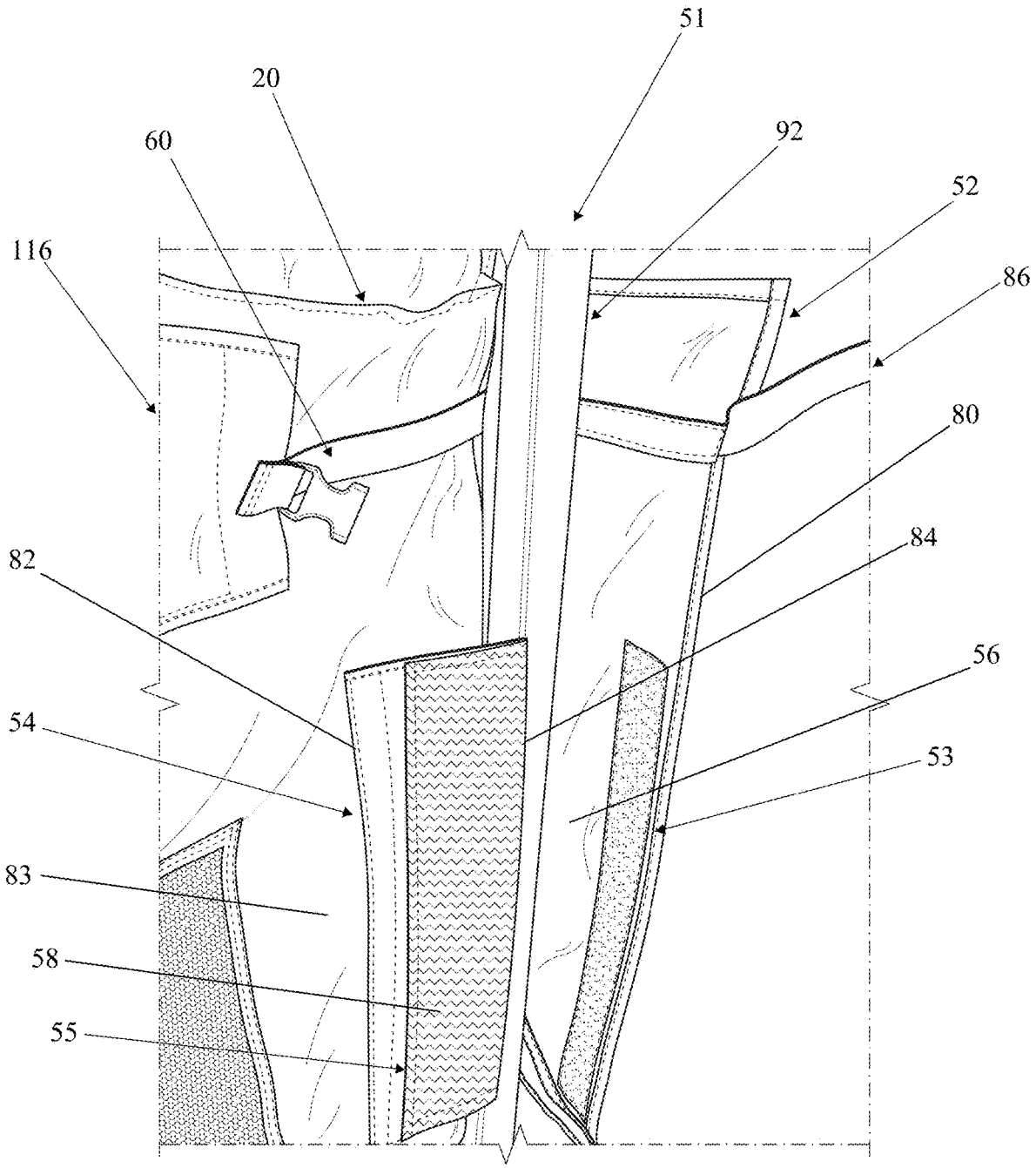
FIG. 8 is an up-close view of the attachment flap of the version of the sealable bedding enclosure shown in FIG. 1.
Figure 9:
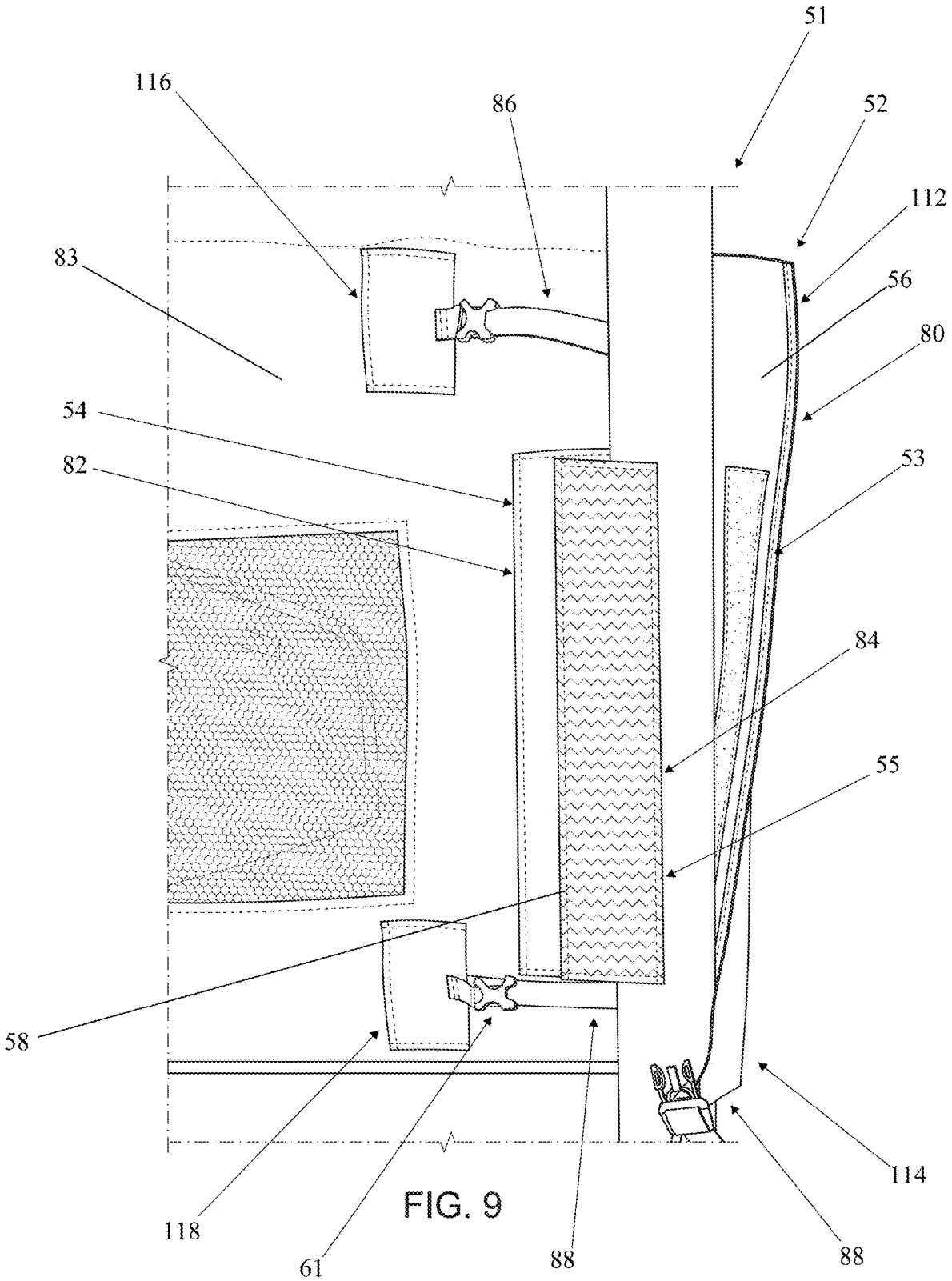
FIG. 9 is an up-close view of the attachment flap of the version of the sealable bedding enclosure shown in FIG. 1.
Figure 10:
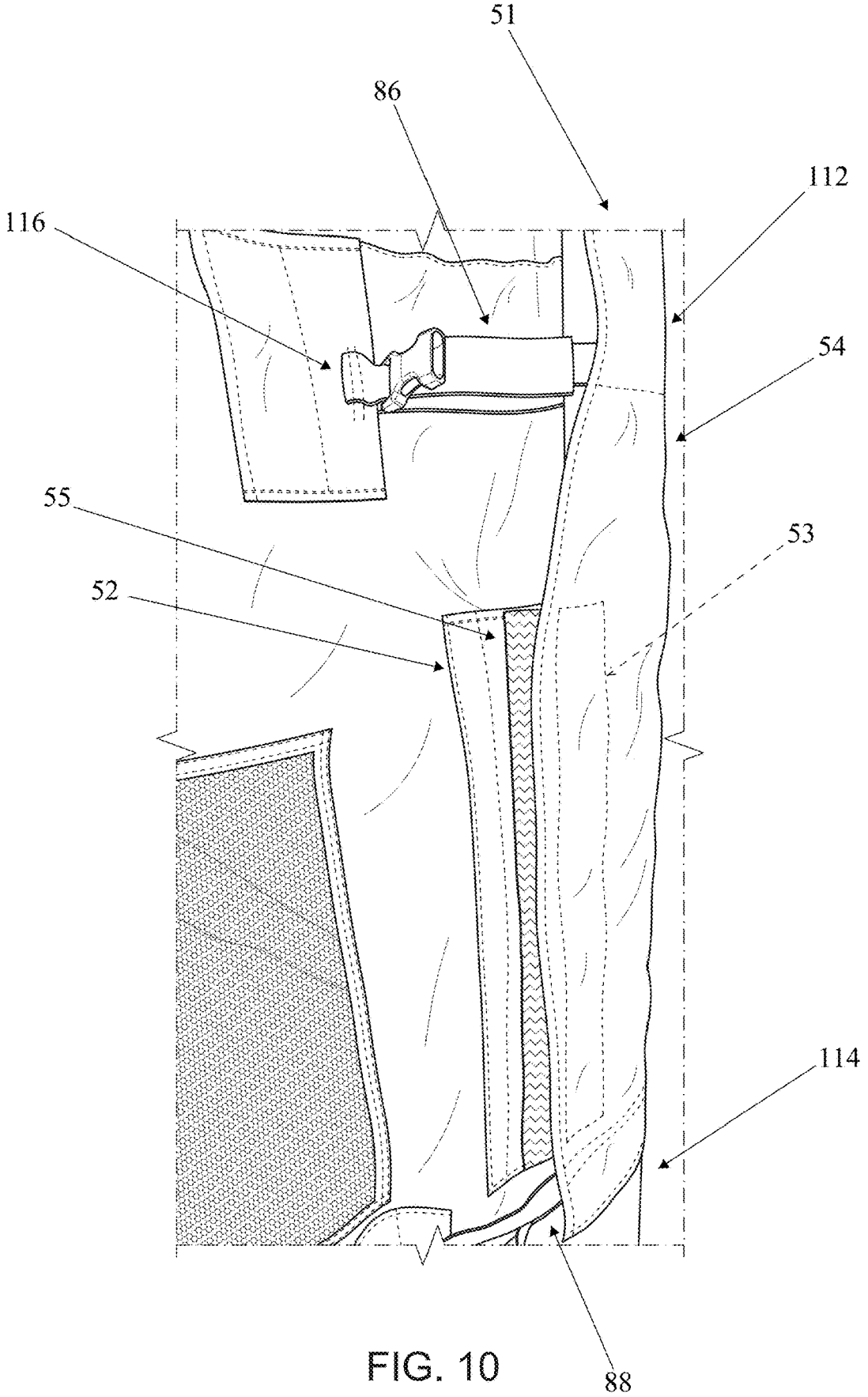
FIG. 10 is an up-close view of the attachment flap of a version of the application while the primary corner attachment flap and the secondary attachment flap are in an attached configuration.
Figure 11:
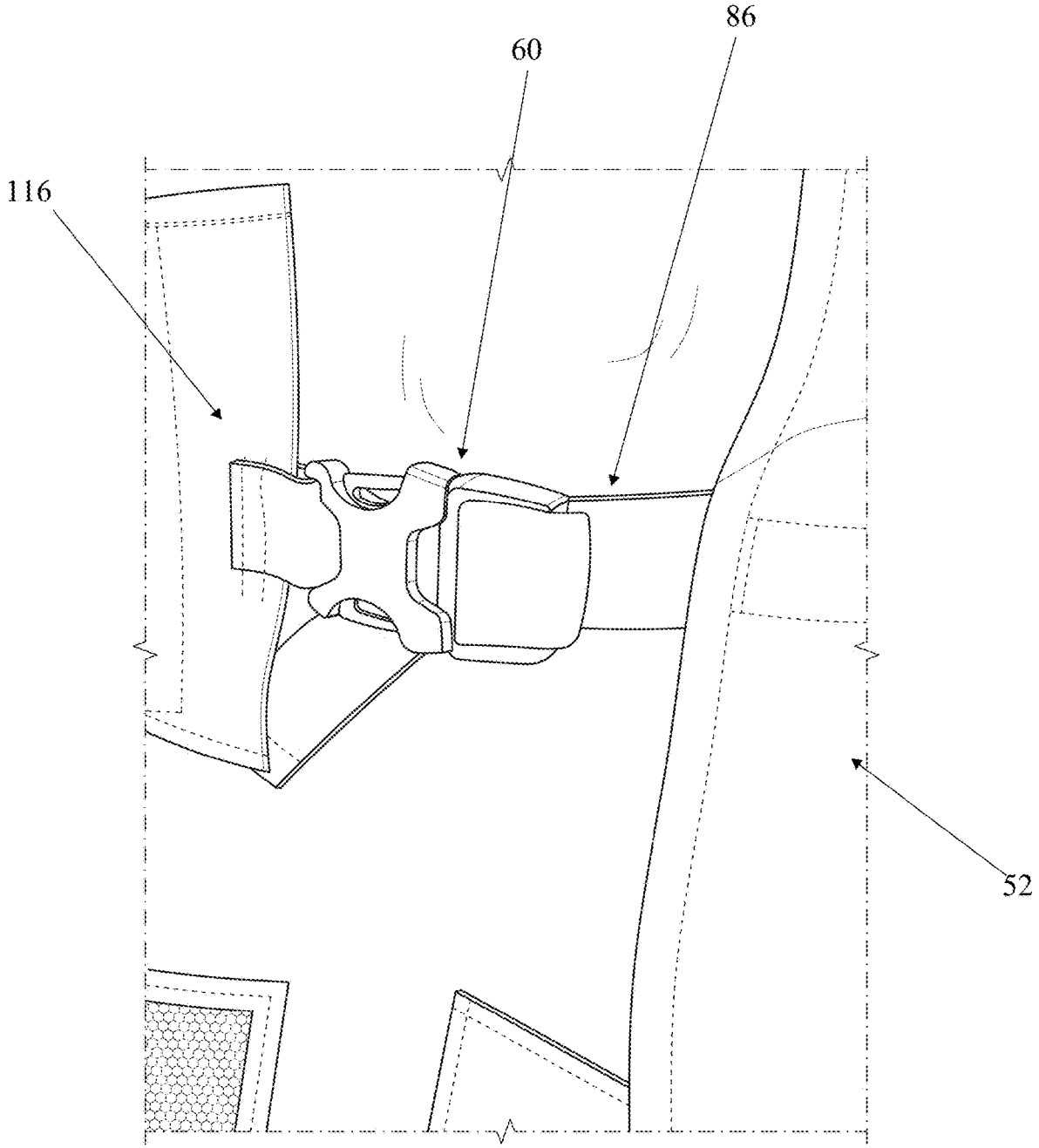
FIG. 11 is an up-close view of the length adjustable strap and side release buckle of the version shown in FIG. 11.

Preferably, the interior surface 56 of each primary corner attachment flap 52 is lined with a hook and loop material strip 53 and the exterior surface 58 secondary corner flap 54 is lined with a reciprocal hook and loop material strip 55. As shown in FIG. 8, the interior surface 56 of the primary corner attachment flap 52 coincides with the exterior surface 58 of the secondary corner attachment flap 54 such that while attached to each other, the hook and loop material strips 53, 55 adhere to each other—essentially attaching the vertical corner 51 perimeter of the sealable bedding enclosure 10 to the respective column 92 of the bunk bed 90.

Further, each respective vertical corner 51 of the sealable bedding enclosure 10 may include a first length adjustable strap 86 and side release buckle 60, and a second length adjustable strap 88 and side release buckle 61 for providing additional securement of the primary corner attachment flap 52 to the adjacent vertical panel. Preferably, the first length adjustable strap 86 is positioned at the upper portion 112 of each of the primary corner attachment flaps 52 and the second length adjustable strap 88 is positioned at the lower portion 114 of the primary corner attachment flaps 52. Thus, the first length adjustable strap 86 connects from the upper portion 112 of the primary corner attachment flap 52 to a respective upper anchor point 116 affixed to the upper side of the exterior surface 83 of the adjacent panel, for example, the first end panel 20. The second length adjustable strap 88 connects the lower portion 114 of the primary corner attachment flap 52 to a respective lower anchor point 118 affixed to the lower side of the exterior surface 83 of the adjacent panel, for example, the first end panel 20. Thus, in conjunction with the hook and loop material strips 53, 55, the first and second length adjustable straps 86, 88 and side release buckles 60, 61 further secure the primary corner attachment flaps 52 around the respective bunk bed 90 vertical columns 92 and to the adjacent vertical panel.

In certain versions of the application, it is preferable that the height of the primary corner attachment flap 52 is greater than the height of the secondary corner attachment flap 54. In certain versions of the application, it is preferable that the width of the primary corner attachment flap 52 is greater than the width of the secondary corner attachment flap 54.

Figure 15:
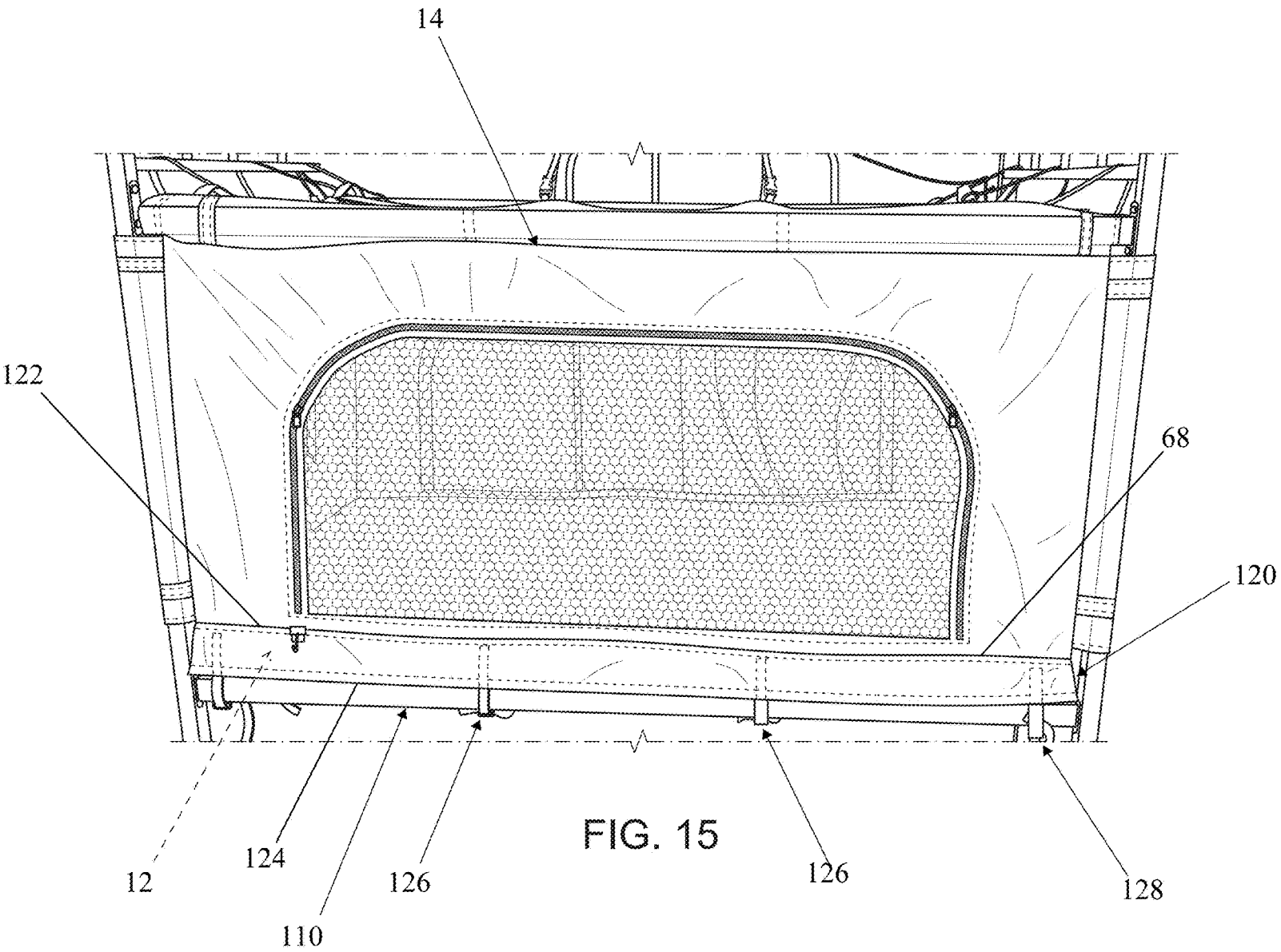
FIG. 15 is a front perspective view of an alternative version of the application.
Figure 16:
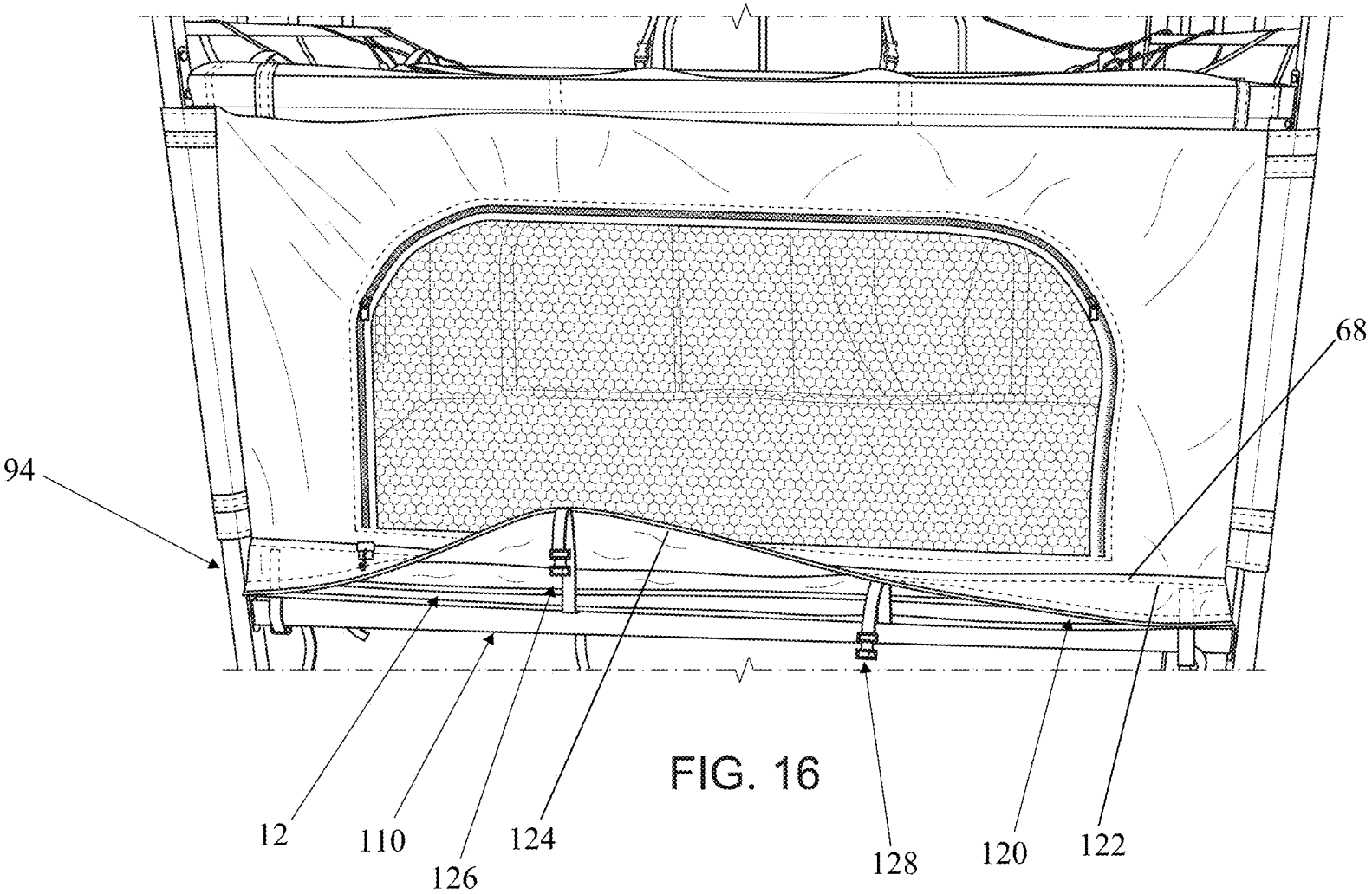
FIG. 16 is a front perspective view of the alternative version shown in FIG. 15.

With reference to FIG. 15 and FIG. 16, an alternate embodiment of the application positions the mattress 12 exterior of the sealed interior space 24. Preferably, the mattress 12 is positioned below the bottom panel 11 directly onto the existing bedding structure 90 lower bunk platform 94 lateral slats 98 during installation.

In the alternate version, the sealable bedding enclosure 10 further comprises a plurality of bottom attachment flaps 120 aligned along the bottom panel 11 perimeter 68, each having a fixed perimeter 122 and a movable perimeter 124. The version further includes a plurality of length adjustable straps 126 and associated buckles 128 that connect the movable perimeters 124 of the plurality of the bottom attachment flaps 120 to existing bedding structure. The plurality of bottom attachment flaps 120 are positioned to conceal the mattress front, rear, and opposing end perimeters.

The present invention can be made in any manner and of any material chosen with sound engineering judgment. Preferably, materials will be strong, lightweight, long lasting, economical, and ergonomic. The invention materials may include light weight plastic or composite material, nylon for netting and windows, and other materials such as felt.

The previously described versions of the present invention have many advantages, including providing a unique, lightweight bedding enclosure specifically tailored for special needs children that is stable, fun and safe. The invention opens up new opportunities for parents, caretakers and special needs children to convert existing bunk bed structures into a sealed space. Although the present disclosure and its advantages have been described in detail, it should be understood that various changes, substitutions and alterations can be made herein without departing from the spirit and scope of the disclosure as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A sealable bedding enclosure for attaching to an existing bedding structure, the bedding enclosure comprising:

a plurality of panels comprising a first side panel, a second side panel, a third side panel, a fourth side panel, a top panel, and a bottom panel forming a sealed interior space, each panel having an exterior surface; and one or more vertical corners formed between at least two adjacent side panels of the plurality of panels, each vertical corner having a vertical length, each adjacent side panel having a vertical length, wherein at least one of the vertical corners comprises:

a primary corner attachment flap having a vertical length that is substantially the vertical length of the vertical corner, the primary corner attachment flap is offset downward relative to the vertical length of each of the adjacent side panels, exposing a flexible top attachment flap portion of each of the adjacent side panels, each top attachment flap portion is configured to secure with the top surface of the top panel, the primary corner attachment flap comprising:

a fixed perimeter attached to the exterior surface of a first panel of the at least two adjacent panels;

a movable perimeter; and a surface positioned between the fixed perimeter and the movable perimeter, the surface for supporting hook and loop material;

an opposing secondary corner attachment flap comprising:

a fixed perimeter attached to the exterior surface of a second panel of the at least two adjacent panels;

a movable perimeter; and a surface positioned between the fixed perimeter and the movable perimeter supporting reciprocal hook and loop material for coupling with the hook and loop material of the primary corner attachment flap.

2. The sealable bedding enclosure of claim 1, wherein the at least one of the vertical corners further comprises a first length adjustable strap and buckle attached between the primary corner attachment flap and the exterior surface of the second panel of the at least two adjacent panels; and a second length adjustable strap and buckle attached between the primary corner attachment flap and the exterior surface of the second panel of the at least two adjacent panels.

3. The sealable bedding enclosure of claim 2, wherein the reciprocating hook and loop material of the primary corner attachment flap is vertically positioned between the attached first length adjustable strap and buckle and the second length adjustable strap and buckle.

4. The sealable bedding enclosure of claim 3, wherein the fixed perimeter and the movable perimeter of the primary corner attachment flap are linear and aligned in parallel, forming a vertical extending elongated flap.

5. The sealable bedding enclosure of claim 4, wherein the fixed perimeter and the movable perimeter of the secondary corner attachment flap are linear and aligned in parallel, forming a vertical extending elongated flap.

6. The sealable bedding enclosure of claim 1, wherein the plurality of panels further comprise a bottom panel having a perimeter, wherein the sealable enclosure further comprises one or more bottom attachment flaps aligned along the bottom panel perimeter, each having a fixed perimeter and a movable perimeter, and a plurality of length adjustable straps and buckles that connect the movable perimeters of the one or more bottom attachment flaps to the bottom panel.

7. The sealable bedding enclosure of claim 6, wherein the fixed perimeter and the movable perimeter of the one or more bottom attachment flaps are linear and aligned in parallel, forming a horizontal elongated flap.

8. The sealable bedding enclosure of claim 6, wherein the plurality of panels further comprise a top panel having a perimeter, wherein the sealable enclosure further comprises one or more top attachment flaps aligned along the top panel perimeter, each top attachment flap having a fixed perimeter and a movable perimeter, and a plurality of length adjustable straps and buckles that connect the movable perimeters of the one or more top attachment flaps to the top panel.

9. The sealable bedding enclosure of claim 8, wherein the fixed perimeter and the movable perimeter of the one or more top attachment flaps are linear and aligned in parallel forming a horizontal elongated flap.

10. The sealable bedding enclosure of claim 1, wherein one or more of the plurality of panels further comprise a zipper-closable flap having a zipper located at the perimeter thereof configured to open and close to provide ingress and egress to the interior space, the zipper-closable flap made of a breathable mesh netting.

11. The sealable bedding enclosure of claim 10, wherein one or more of the plurality of panels further comprise a first and second side windows respectively, the first and second side windows manufactured of a breathable mesh netting.

12. The sealable bedding enclosure of claim 1, further comprising a bottom mattress having a front perimeter, a rear perimeter, and opposing end perimeters forming collectively a rectangular footprint positioned interior of the sealable bedding enclosure.

* * * * *